US005937761A

United States Patent [19]

Buschmann et al.

[11] Patent Number: 5,937,761

[45] Date of Patent: Aug. 17, 1999

[54] METHOD AND DEVICE FOR CONTROLLING AND REGULATING A DRYER LOCATED DOWNSTREAM OF A VARNISHING UNIT IN A ROTARY PRINTING PRESS

[75] Inventors: Martin Buschmann, Heidelberg; Sharam Hauck, Reichenberg-Albertshausen, both of Germany

[73] Assignee: Heidelberger Druckmaschinen AG, Heidelberg, Germany

[21] Appl. No.: 09/145,213

[22] Filed: Aug. 31, 1998

[30] Foreign Application Priority Data

Aug. 29, 1997 [DE] Germany ..... 197 37 785

[51] Int. Cl.[6] ..... B41F 35/00

[52] U.S. Cl. ..... 101/424.1; 101/487; 34/259

[58] Field of Search ..... 101/424.1, 487, 101/488, 416.1, 419, 424.2, DIG. 45; 34/259, 260

[56] References Cited

U.S. PATENT DOCUMENTS

| | | | |
|---|---|---|---|
| 3,636,637 | 1/1972 | Keith | 34/255 |
| 4,485,284 | 11/1984 | Pakulis | 219/705 |
| 4,882,992 | 11/1989 | Schmoeger | 101/424.1 |
| 5,060,572 | 10/1991 | Waizmann | 101/424.1 |
| 5,233,762 | 8/1993 | Muller et al. | 34/246 |
| 5,602,746 | 2/1997 | Loffler | 364/468.01 |

FOREIGN PATENT DOCUMENTS

| | | |
|---|---|---|
| 24 58 935 | 6/1975 | Germany . |
| 34 15 310 C2 | 5/1986 | Germany . |
| 34 13 852 C2 | 10/1986 | Germany . |
| 37 02 218 A 1 | 10/1987 | Germany . |
| 41 10 786 A1 | 10/1992 | Germany . |
| 43 25 725 A1 | 2/1995 | Germany . |
| 2 254 438 | 10/1992 | United Kingdom . |

*Primary Examiner*—Edgar Burr
*Assistant Examiner*—Minh H. Chau
*Attorney, Agent, or Firm*—Herbert L. Lerner; Laurence A. Greenberg

[57] ABSTRACT

A method for controlling and regulating a dryer in a rotary printing press having a varnishing device for varnishing printing stock processed in the printing press, includes measuring the intensity of a microwave signal after the microwave signal has interacted with varnished and dried printing stock fed through the rotary printing press; from the measured radiation intensity of the microwave signal, forming a status variable representing a measure of the degree of drying of the printing stock; and varying drying power provided by the dryer as a function of the formed status variable; and a device for performing the method.

15 Claims, 4 Drawing Sheets

METHOD AND DEVICE FOR CONTROLLING AND REGULATING A DRYER LOCATED DOWNSTREAM OF A VARNISHING UNIT IN A ROTARY PRINTING PRESS

BACKGROUND OF THE INVENTION

Field of the Invention

The invention relates to a method and device for controlling and regulating a dryer located downstream of a varnishing unit in a rotary printing press.

Rotary printing presses with varnishing devices and dryers located downstream therefrom for drying printing stock varnished in the varnishing devices have become known heretofore in the prior art. For example, sheets which have been printed in printing units of sheet-fed rotary offset printing presses are coated with a varnish layer in a varnishing unit disposed downstream of the printing units, and the sheets are then guided past a conventional dryer in the form of an infra-red (IR), hot-air, or ultra-violet (UV) dryer, wherein the varnished sheets are dried before being deposited on a delivery pile.

The pressman operating heretofore known sheet-fed rotary offset printing presses is faced with the problem that the sheets will stick together or adhere when deposited on a sheet pile in the delivery system, if the varnish remains damp or is too damp, in the case where the dryer power is too low and the sheets remain in the dryer for too short a time, respectively. To counteract adherence or sticking of the sheets, they are therefore coated in the delivery region with a layer of powder in a conventional manner, which not only increases operating costs but also leads to unnecessary soiling and to an impairment of print quality.

On the other hand, if the dryer power is set too high or the sheets remain too long in the dryer, the viscosity of the varnish that has already begun to dry is reduced again because of the higher temperature, so that, when the sheets are deposited on the sheet pile, they become stuck together, in like manner. In addition, the energy consumption of the dryer, which is already a major energy consumer, is further increased. To enable the dryers to be set or adjusted in practice to a more or less optimal operating range, it has become known heretofore from the Speedmaster 102 series of Heidelberger Druckmaschinen A. G., the corporate assignee of the instant application, to monitor the temperature of the delivery pile with a temperature sensor, so that if a given value for the sheet pile temperature is exceeded, the pressman can lower the power of the dryer. Then, however, the problem arises that the measured pile temperature does not provide the dryer with any indication of a lower limit for the dryer power that is outputted. In order to obtain such a lower limit for the dryer power at the application production run speed, a subjective assessment of the degree or extent of drying of the varnished sheets laid on the sheet pile is made by the pressman, in practice, through the use of his fingers, for example, by checking the tackiness of the varnish. Depending upon what he or she finds, the pressman or other operator then selects the dryer power and the quantity of powder used for a given production run speed and pile height, so as to just barely prevent the sheets from sticking together. Because of this subjective measuring method to set or adjust the optimal dryer power, in practice, disruptions in operation often occur, along with unnecessarily high powder consumption and high incidence of spoiled copies.

SUMMARY OF THE INVENTION

It is accordingly an object of the invention to provide a method and device for controlling and regulating a dryer located downstream from a varnishing unit in a rotary printing press by which power supplied to the dryer can be controlled and regulated in a precise, replicable manner during a production run of the printing press.

With the foregoing and other objects in view, there is provided in accordance with one aspect of the invention, a method for controlling and regulating a dryer in a rotary printing press having a varnishing device for varnishing printing stock processed in the printing press, which comprises measuring the intensity of a microwave signal after the microwave signal has interacted with varnished and dried printing stock fed through the rotary printing press; from the measured radiation intensity of the microwave signal, forming a status variable representing a measure of the degree of drying of the printing stock; and varying drying power provided by the dryer as a function of the formed status variable.

In accordance with another mode of the method according to the invention, the radiation intensity of the microwave signal is measured both upstream and downstream of the dryer, as viewed in transport direction of the printing stock, and the method includes determining the status variable with the aid of at least one of the difference between and ratio of, respectively, the intensities measured upstream and downstream of the dryer.

In accordance with a further mode, the method according to the invention includes determining the status variable by comparing the measured radiation intensities of the microwave signal with intensity values stored in memory, together with values for the status variable associated therewith, in a values table obtained by calibration.

In accordance with an added mode, the method according to the invention includes selecting the frequency of the microwave radiation so that the varnish of the varnished layer on the printing stock absorbs the microwave radiation to a high degree, when compared with the extent to which the microwave radiation is absorbed by other material of the printing stock.

In accordance with an additional mode, the method according to the invention includes applying offset spray powder to the dried printing stock, and controlling and regulating the quantity of offset spray powder as a function of the status variable.

In accordance with another aspect of the invention, there is provided a device for controlling a dryer in a rotary printing press having a varnishing unit, comprising a microwave transmitter located downstream from the dryer for emitting microwave radiation in a direction towards a surface of a varnished printing stock transported through the printing press; a microwave receiver associated with the microwave transmitter for detecting the radiation emitted by the microwave transmitter after the radiation has interacted with the printing stock and for generating corresponding electronic signals, and an electronic control and evaluation device for generating a status variable representing a measure of the degree of drying of the varnish on the printing stock from the electronic signals of the microwave receiver.

In accordance with a further feature of the invention, the dryer-controlling device according to the invention comprises a display for representing in visual form a value determined by the electronic control and evaluation device for the status variable.

In accordance with an added feature of the invention, the dryer-controlling device includes a power supply via which the electronic control and evaluation device is capable of varying power supplied to the dryer as a function of the value for the status variable, so that the printing stock, after passing through the dryer, has a predetermined degree of drying.

In accordance with an additional feature of the invention, the microwave transmitter and the microwave receiver associated therewith are disposed above and below a travel path of the printing stock in the printing press so that the varnished printing stock travels between the microwave transmitter and the microwave receiver, the microwave receiver being capable of detecting the intensity of the microwave radiation after the microwave radiation has penetrated the printing stock.

In accordance with yet another feature of the invention, the microwave transmitter and the microwave receiver associated therewith are disposed on the same side of a transport path of the printing stock in the printing press, the microwave receiver being capable of detecting the intensity of the microwave radiation after the radiation has been reflected by the varnished printing stock.

In accordance with yet a further feature of the invention, the microwave transmitter has a radiation power of less than 150 mW.

In accordance with yet an added feature of the invention, at least one of the microwave transmitter and the microwave receiver is disposed in a guide face of a pneumatic printing stock guide element for guiding the varnished printing stock along a travel path thereof at a substantially constant spacing from the guide face.

In accordance with yet an additional feature of the invention, the microwave receiver is disposed in a circumferential surface of a rotating printing press cylinder, and the microwave transmitter associated therewith is disposed locally fixed near the circumferential surface of the printing press cylinder.

In accordance with still another feature of the invention, the dryer-controlling device includes a further microwave transmitter and a microwave receiver associated with the further microwave transmitter disposed upstream of the dryer, as viewed in a travel direction of the printing stock through the printing press, for generating a further electronic signal applicable by the electronic control and evaluation device for determining the status variable.

In accordance with a concomitant feature of the invention, the dryer-controlling device includes a device located downstream from the dryer, as viewed in a travel direction of the printing stock through the printing press, for applying to the dried printing stock an offset spray powder in a quantity variable by the powder-applying device as a function of the status variable.

The invention has the advantage in particular that the degree of drying of the varnish on the varnished and dried sheets can now be determined in a defined and replicable way from a status variable, which represents a measure of the applicable degree of drying of the sheet, so that the pressman, in order to find an optimal operating range of the dryer, is no longer forced to make a subjective assessment, based upon trial and error, of the surface of the printing stock.

The apparatus and method of the invention also provide the advantage that the quantity of offset spray powder applied to the varnished and dried sheets of stock in a conventional manner in order to prevent the sheets from adhering or sticking together, can be optimally controlled and regulated automatically as a function of the status variable.

Other features which are considered as characteristic for the invention are set forth in the appended claims.

Although the invention is illustrated and described herein as embodied in a method and device for controlling and regulating a dryer located downstream from a varnishing unit in a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
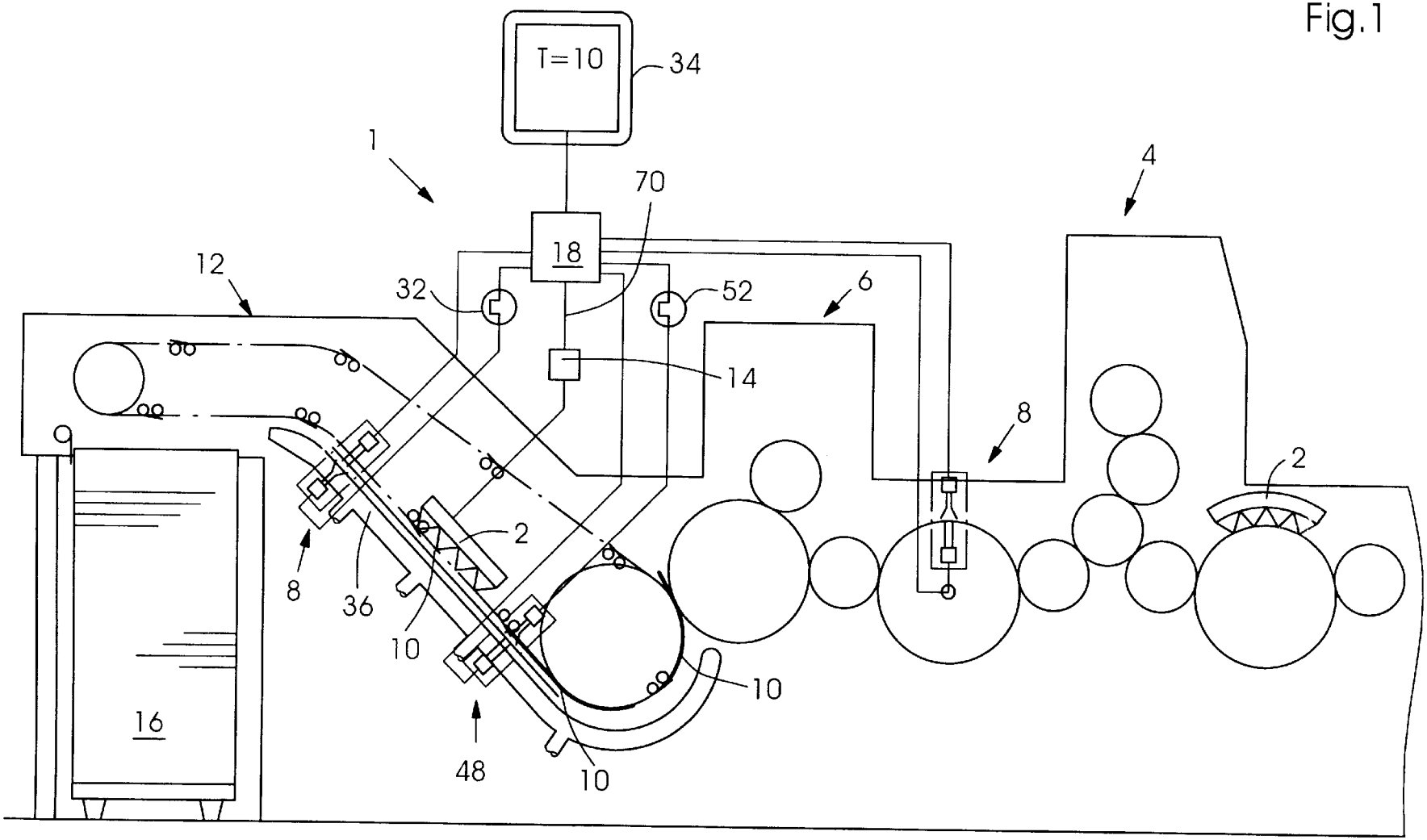
FIG. 1 is a fragmentary diagrammatic side elevational view of a sheet-fed rotary offset printing press having a varnishing unit, and a dryer located downstream from the varnishing unit, and a plurality of microwave measuring instruments disposed in various sections of the printing press.

Referring now to the drawings and, first, particularly to FIG. 1 thereof, there is shown therein a device 1 according to the invention for controlling a dryer 2 in a rotary printing press 4 having a varnishing unit 6 disposed upstream of the dryer 2, including a first microwave measuring instrument 8 which, as shown in FIG. 1, is disposed downstream of the dryer 2 for drying the varnished printing stock 10. Although the device and method according to the invention are not limited to use in a sheet-fed rotary offset printing press shown in FIG. 1, and can, for example, also be used in conventional web-fed rotary printing presses with varnishing devices for a web of printing stock, they will be described hereinbelow only with respect to a sheet-fed rotary offset printing press, as an example.

The dryer 2 shown in FIG. 1 may, for example, be a conventional IR dryer or UV dryer, disposed in a delivery system 12 of the printing press 4 and having drying power which can be varied in a conventional manner by suitably varying the electrical power supplied to the dryer 2 by a dryer current supply unit 14. The sheets 10 varnished in the varnishing unit 6 are transported, as shown in FIG. 1, in the delivery system 12 of the printing press 4 under the dryer 2 by a conventional chain delivery system, the varnish on the varnished surface 24 of the sheet 10 being dried by the UV or IR radiation of the dryer 2. The varnishes applied in the varnishing unit 6 may, for example, be heretofore known dispersion varnishes, preferably water-based dispersion varnishes.

After the sheets 10 have passed through the dryer 2, they are placed one on top of the other or superimposed on a delivery pile 16 of the delivery system 12. A heretofore known problem then arises that the varnish layer 26 applied to the sheets 10 in the varnishing unit 6 has excessively low viscosity if the dryer power is too low or if it is too high, on the one hand, and, correspondingly, if the dwell time of the sheets 10 in the dryer 2 is too short or too long, on the other hand, respectively, thereby causing the sheets 10 to stick together or adhere, particularly at the bottom of the sheet pile 16.

Figure 3:
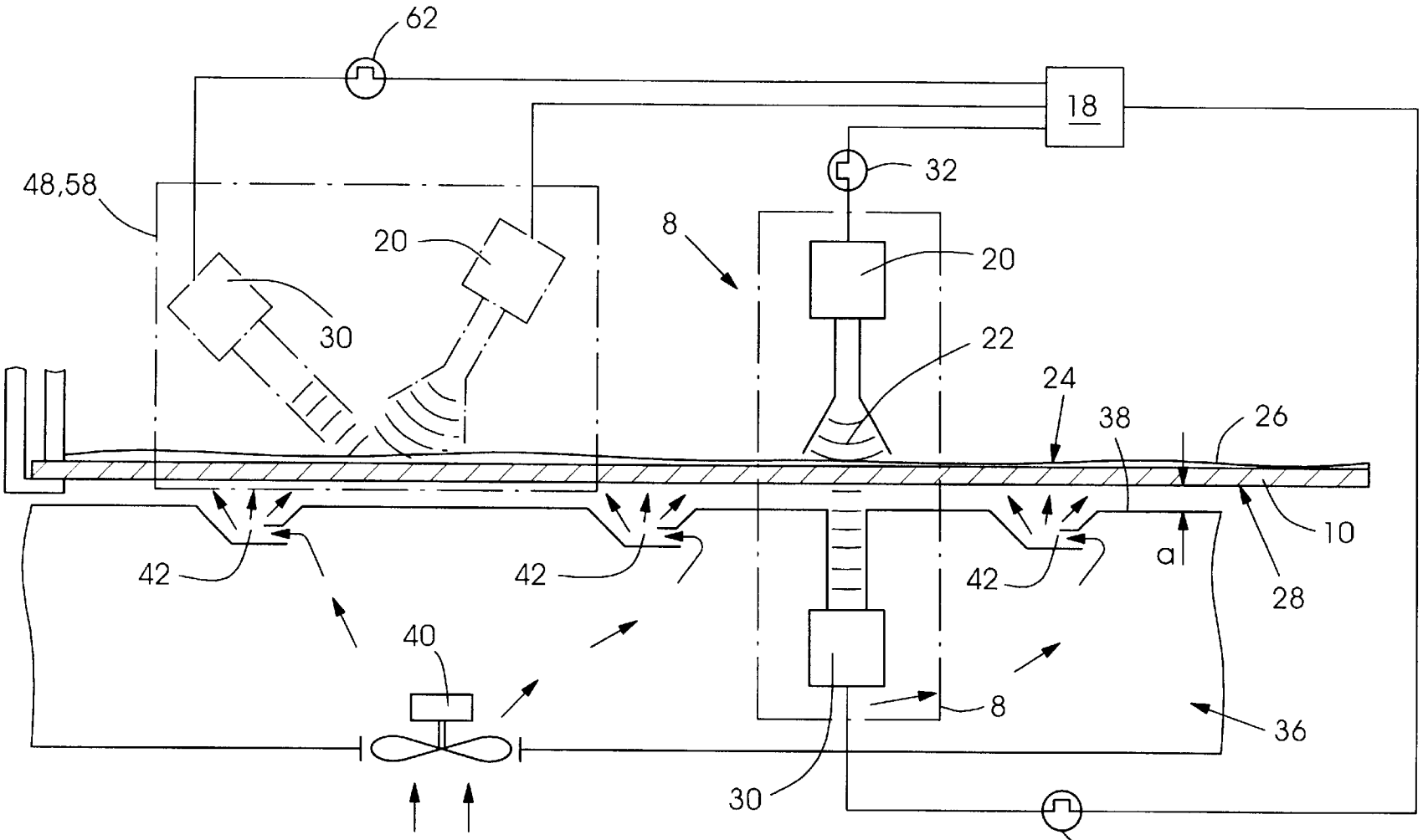
FIG. 3 is a view like that of FIG. 2 showing in greater detail the embodiment of FIG. 1 having a pneumatic sheet guiding device with a sheet guided at a constant spacing thereon, and a microwave measuring instrument according to the invention, having a receiver thereof disposed inside the sheet guiding device and a transmitter thereof disposed outside the sheet guiding device.

As shown in FIG. 1 and in greater detail in FIG. 3, the device 1 according to the invention also includes an electronic control and evaluation device 18, which is preferably realized by a conventional computer, such as a microcomputer, and appropriate software.

The microwave measuring instrument 8 disposed between the varnishing unit 6 and the dryer 2 of the printing press 4 includes a conventional microwave transmitter 20, which transmits microwave radiation 22, at a wavelength preferably within the range of 0.5 mm to 2 cm, in a direction towards the surface 24 of the printed and varnished sheet 10, and this radiation 22 interacts with the varnish layer 26 on the sheet 10 and is partly absorbed thereby. In a preferred embodiment of the invention, the wavelength or frequency of the microwave radiation 22 is selected so that the varnish of the varnish layer 26 absorbs the microwave radiation 22 to a high degree, when compared with the extent to which it is absorbed by the material of the printing stock. The microwave transmitter 20 preferably has a power of less than 150 mW, which ensures that the microwave radiation 22 does not cause local heating or other change in the varnish layer 26.

As shown in detail in FIG. 3, a microwave receiver 30 located opposite the microwave transmitter 20 is disposed on the unvarnished underside 28 of the sheet 10 and detects the microwave radiation 22, after this radiation has penetrated the sheet 10 and has begun to interact with the varnish layer 26.

In the preferred embodiment of the invention, the microwave receiver 30 converts the microwave signals 22 received thereby into corresponding electronic signals 32, which correspond to the intensity of the detected microwave radiation 22. The electronic signals 22 are conducted, via an unidentified line shown at the right-hand side of FIG. 3, to the electronic control and evaluation device 18, which generates a status variable T therefrom representing a measure of the degree or extent of drying of the varnish layer 26 on the sheet 10. The status variable T, as shown in FIG. 1, may be indicated on a display 34, for example, so that the printer can adjust the power of the dryer 2 manually, based thereon. Provision may also be made for an additional target value of the degree or extent of drying to be shown on the display 34; this value is determined by the electronic control and evaluation device 18, for example, as a function of the speed of the printing press, the quantity of varnish applied, the type of varnish, the printing stock being processed, the quantity of powder used, and so forth.

As also shown in FIG. 3, the microwave sensor 30 of the invention is preferably incised or inserted into a guide face 38 of a pneumatic sheet guide element or printing stock guide element 36, which is subjected in a conventional manner to blown or blast and/or aspirated air from an axial fan 40, the air then emerging from the guide face 38 through diagrammatically represented nozzles 42. The sheet guide element 36 guides the sheet 10 in a conventional manner at a substantially constant spacing a above the guide face 38.

Figure 2:
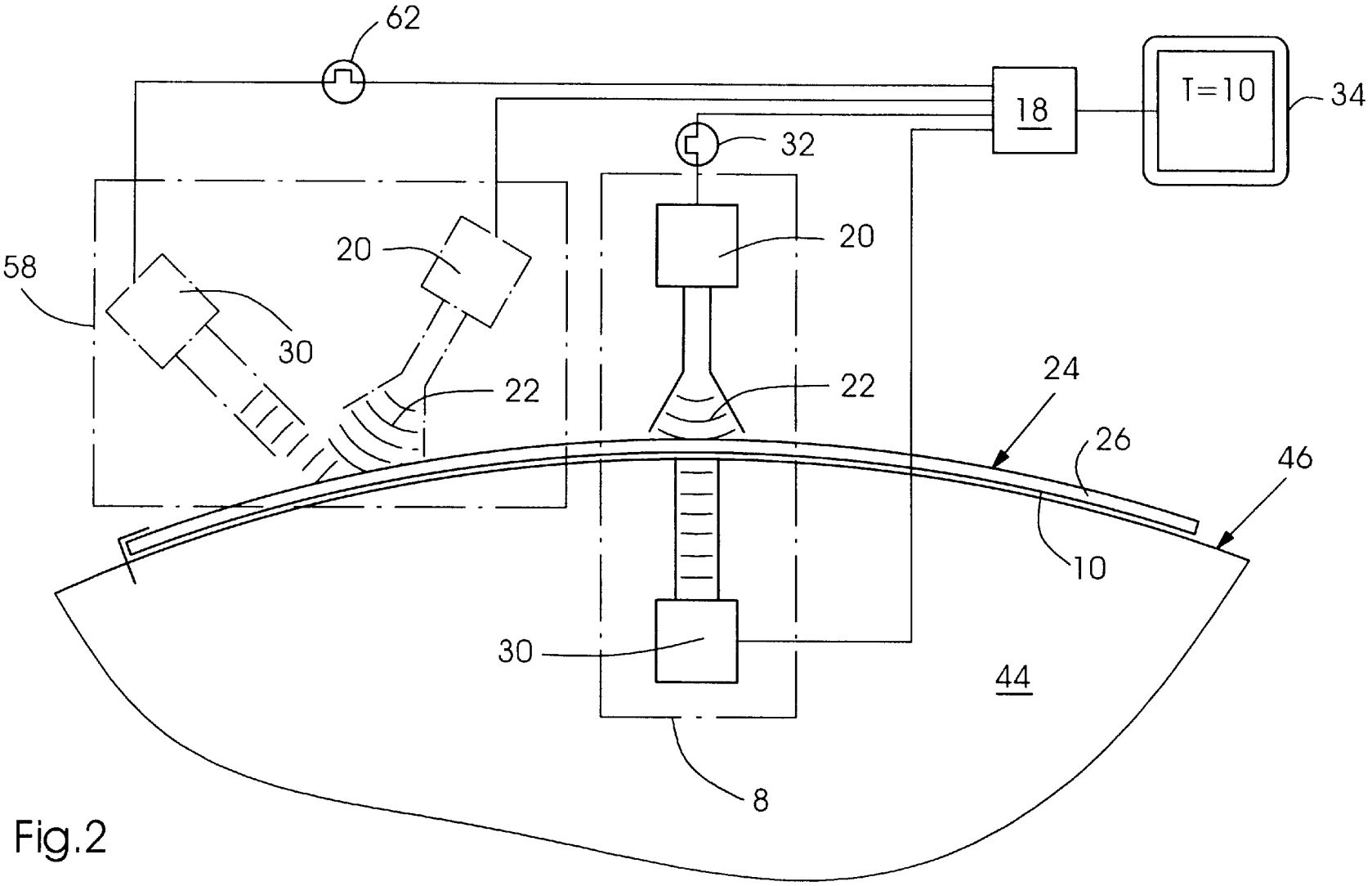
FIG. 2 is a schematic and diagrammatic view of a microwave measuring instrument according to the invention having a microwave receiver disposed in the circumferential surface of a rotating printing press cylinder, and a microwave transmitter provided above printing stock transported on the printing press cylinder.

Instead of using a microwave measuring instrument 8 according to the invention in a pneumatic sheet guide element 36, for example, in the delivery region of the printing press 4, provision may also be made, as shown, for example, in FIGS. 1 and 2, for the microwave measuring instrument 8 to be disposed on a rotating printing press cylinder 44 located downstream from an associated non-illustrated varnishing device. In this embodiment of the invention, the microwave transmitter 20 is preferably disposed locally fixed above the circumferential surface 46 of the printing press cylinder 44. The associated microwave receiver 30, conversely, is incised or inserted into the circumferential surface 46 of the printing press cylinder 44 and rotates therewith. In this embodiment of the invention, the signals 32 generated by the microwave receiver 30, which are conducted to the electronic control and measuring device 18, for example, by a conventional electrical rotary leadthrough, have a periodically peak-shaped form dictated by the rotation of the printing press cylinder 44. The determination of the status variable T according to the invention, which represents a measure of the degree or extent of drying of the varnish layer 26 on the varnished sheet 10, is effected in this embodiment of the invention preferably with the aid of the maximum values for the intensity of the microwave radiation 22 that are received by the receiver 30.

As also shown in FIG. 1, one or more microwave measuring instruments 48 may be provided in the region of the delivery system 12, upstream of the dryer 2 in terms of the sheet travel direction, and have a construction like the microwave measuring instrument 8 disposed downstream of the dryer 2, for transmitting to the electronic control and evaluation device 18 additional signals 52 of an intensity corresponding to the intensity of the microwave radiation 22 received, once this radiation has passed through the undried sheet 10. By a comparison of the signals 32 and 52, for example, by forming the quotient and/or difference between the signals, the electronic control and evaluation device 18 gains an additional criterion for determining the status variable T, so that the status variable T can be ascertained with greater precision.

In a further embodiment of a microwave measuring instrument according to the invention, which is identified by reference numeral 58 and represented in broken lines in FIGS. 2 and 3, the microwave transmitter 20 and the microwave receiver 30 associated therewith are disposed on the same side, preferably on the side with the varnish layer 26, at an angle from one another; the microwave radiation 22 emitted by the microwave transmitter 20 at an angle toward the varnished surface 26 of the sheet 10 is partly absorbed by the surface 26 and partly reflected. The portion of the microwave radiation 22 reflected by the surface 26 is received by the microwave receiver 30 and converted into an electronic signal 62, which is delivered to the electronic control and evaluation device 18 and corresponds to the intensity of the microwave radiation received by the microwave receiver 30. The microwave measuring instrument 58 according to the invention, shown in FIG. 2 and operating by the reflection method, is not limited to being used in a rotating printing press cylinder 44; it may be used in like manner in conjunction with a pneumatic sheet guide element 36, as represented by broken lines in FIG. 3.

Although it may suffice, as described hereinabove, merely to show the status variable T on a display 34 in order to provide the pressman with a reliable criterion for him to vary the dryer power to prevent the varnished sheets 10 from adhering or sticking together, the status variable T is preferably used for automatically controlling the dryer power.

As shown in FIG. 1, the dryer current supply unit 14 and the control unit of the dryer 2, respectively, are connected for this purpose to the electronic control and evaluation device 18 via a line 70.

Figure 4:
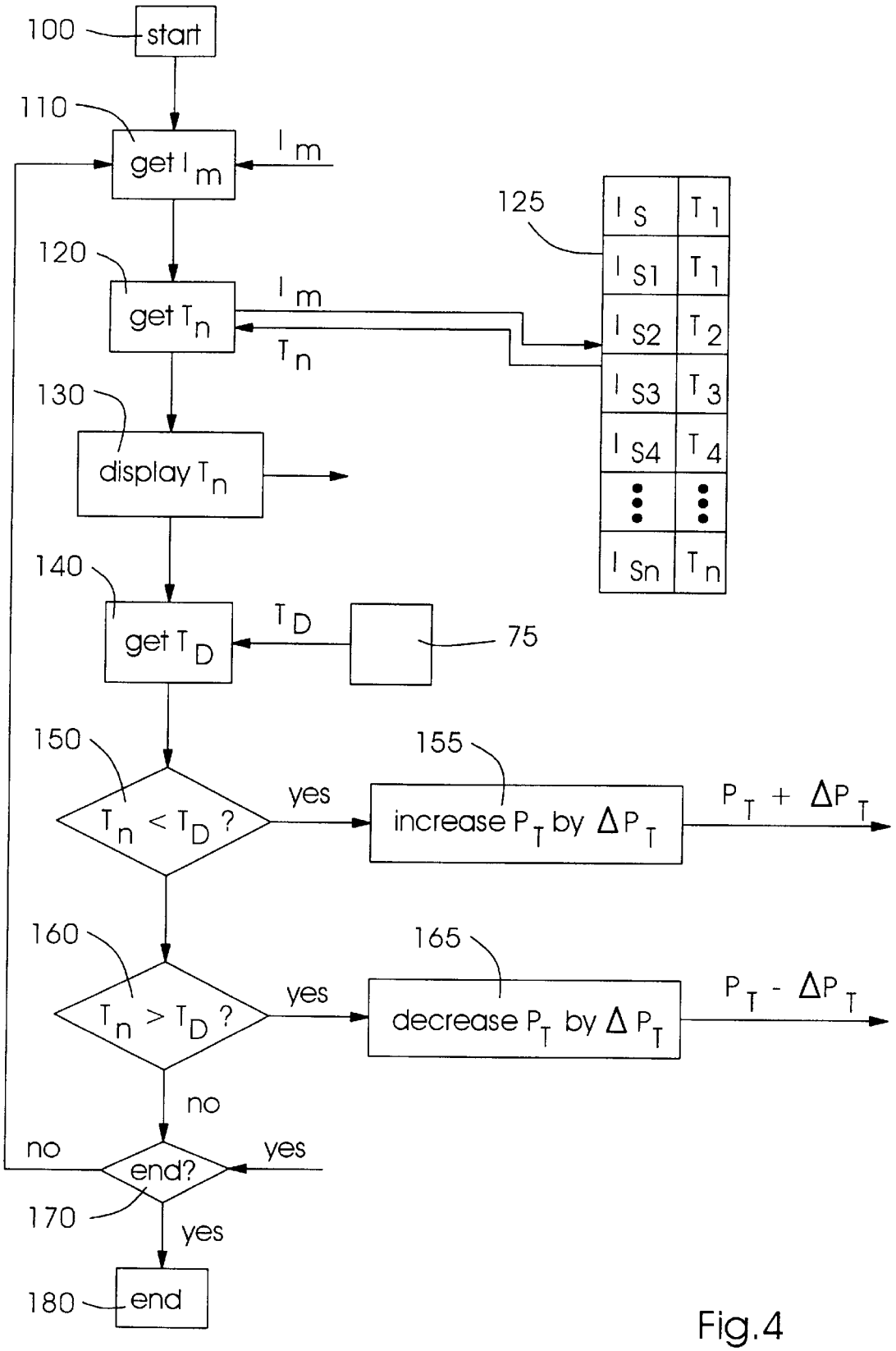
FIG. 4 is a flow chart illustrating the mode of operation of the device and method according to the invention.

The electronic control and evaluation device 18 includes corresponding control and regulating software having a mode of operation which is described in further detail hereinbelow, taking the flowchart of FIG. 4 as an example.

After the start of the program in step 100, in step 110, a value $I_M$ formed from the signals 32 and/or 62 for the intensity of the microwave radiation 22 received by the microwave receiver or receivers 20 is read.

In the next step 120, the electronic control and evaluation device 18 compares the read-out value $I_M$ with a value $I_S$ for the intensity that is stored in memory in a values table 125, along with the associated value for the status variable T, in the form of pairs of values ($I_{S1}$, $T_1$; $I_{S2}$, $T_2$; . . . ; $I_{sn}$, $T_n$) The value pairs $I_{sn}$, $T_n$, of the values table 125 are preferably obtained empirically by calibration measurements, to which end a value $T_n$, for the status variable T is assigned, for example, to an empirical value for the degree or extent of drying of the varnish that has been determined by reflection measurement, ultrasound measurements, or in some other manner, and then the intensity $I_{sn}$ of the received microwave signal 22 for this value $T_n$, is measured. The various value pairs ($I_{sn}$, $T_n$) are then stored in a memory, for example, electronically, in the form of the value table 125.

The value $T_n$ for the status value T read out of the values table 125 in step 120 is then shown in step 130 on the display 34, for example, in the form of a numerical value. As described hereinabove, however, showing it on the display 34 is merely optional.

If direct control of the dryer as a function of the values $T_n$, determined as noted above, for the status variable T is desired, then in step 140 the electronic control and evaluation device 18 reads a desired value $T_D$ from a memory 75; this desired value may be determined, for example, as a function of the aforementioned operating parameters of the printing press, such as printing speed, type of paper used, type of varnish, quantity of powder, sheet pile height, sheet pile temperature, and so forth. The desired value $T_D$ is preferably based upon empirical values obtained by trial and error and stored in the memory 75.

Next, the control and evaluation device 18 in step 150 ascertains whether the applicable value $T_n$ for the status variable T is less than the value $T_D$ read out of the memory in step 140. If the value $T_n$ for the status variable T is less than the desired value $T_D$, then the electronic control and evaluation device 18 increases the power $P_t$ supplied to the dryer 2 by a predetermined, preferably adjustable value $\Delta P_T$, as indicated in step 155.

If the value for $T_n$ is not less than the desired value $T_D$, then in step 160 a query is presented as to whether the applicable value $T_n$ for the status variable T is greater than the desired value $T_D$. If so, then in step 165 the power $P_t$ supplied to the dryer 2 is reduced by a predetermined value $\Delta P_T$. Increasing or decreasing the power $P_t$ supplied to the dryer 2 is performed here via suitable control signals, which the control and evaluation device 18 transmits to the dryer current supply unit 14 and the control unit thereof, respectively.

If the current value $T_n$ for the status variable T in step 160 is not greater than the desired value $T_D$, then in step 170 the query is presented as to whether the measurement should be terminated. If so, the program stops at step 180.

If the measurement should be continued, then a return to step 110 is made, and the next value $I_m$ for the intensity is read out.

Provision may also be made for the control and evaluation device 18 according to the invention to control and regulate, as a function of the status variable T, the quantity of offset spray powder applied to the printing stock, in a conventional manner in a non-illustrated powdering device, so that the optimal quantity of powder for the particular degree or extent of drying of the varnish and the printing state of the printing press, a quantity which may likewise be stored electronically in a values table, is automatically set.

We claim:

1. A method for controlling and regulating a dryer in a rotary printing press having a varnishing device for varnishing printing stock processed in the printing press, which comprises measuring the intensity of a microwave signal after the microwave signal has interacted with varnished and dried printing stock fed through the rotary printing press; from the measured radiation intensity of the microwave signal, forming a status variable representing a measure of the degree of drying of the printing stock; and varying drying power provided by the dryer as a function of the formed status variable.

2. The method according to claim 1, wherein the radiation intensity of the microwave signal is measured both upstream and downstream of the dryer, as viewed in transport direction of the printing stock, and which includes determining the status variable with the aid of at least one of the difference between and ratio of, respectively, the intensities measured upstream and downstream of the dryer.

3. The method according to claim 1, which includes determining the status variable by comparing the measured radiation intensities of the microwave signal with intensity values stored in memory, together with values for the status variable associated therewith, in a values table obtained by calibration.

4. The method according to claim 1, which includes selecting the frequency of the microwave radiation so that the varnish of the varnished layer on the printing stock absorbs the microwave radiation to a high degree, when compared with the extent to which the microwave radiation is absorbed by other material of the printing stock.

5. The method according to claim 1, which includes applying offset spray powder to the dried printing stock, and controlling and regulating the quantity of offset spray powder as a function of the status variable.

6. A device for controlling a dryer in a rotary printing press having a varnishing unit, comprising a microwave transmitter located downstream from the dryer for emitting microwave radiation in a direction towards a surface of a varnished printing stock transported through the printing press; a microwave receiver associated with said microwave transmitter for detecting said radiation emitted by said microwave transmitter after said radiation has interacted with the printing stock and for generating corresponding electronic signals, and an electronic control and evaluation device for generating a status variable representing a measure of the degree of drying of the varnish on the printing stock from said electronic signals of said microwave receiver.

7. The dryer-controlling device according to claim 6, comprising a display for representing in visual form a value determined by said electronic control and evaluation device for said status variable.

8. The dryer-controlling device according to claim 7, including a power supply via which said electronic control and evaluation device is capable of varying power supplied to the dryer as a function of said value for said status variable, so that the printing stock, after passing through the dryer, has a predetermined degree of drying.

9. The dryer-controlling device according to claim 6, wherein said microwave transmitter and said microwave receiver associated therewith are disposed above and below a travel path of the printing stock in the printing press so that the varnished printing stock travels between said microwave transmitter and said microwave receiver, said microwave receiver being capable of detecting the intensity of said microwave radiation after said microwave radiation has penetrated the printing stock.

10. The dryer-controlling device according to claim 6, wherein said microwave transmitter and said microwave receiver associated therewith are disposed on the same side of a transport path of the printing stock in the printing press, said microwave receiver being capable of detecting the intensity of said microwave radiation after said radiation has been reflected by the varnished printing stock.

11. The dryer-controlling device according to claim 10, including a further microwave transmitter and a microwave receiver associated with said further microwave transmitter disposed upstream of the dryer, as viewed in a travel direction of the printing stock through the printing press, for generating a further electronic signal applicable by said electronic control and evaluation device for determining said status variable.

12. The dryer-controlling device according to claim 6, wherein said microwave transmitter has a radiation power of less than 150 mW.

13. The dryer-controlling device according to claim 6, wherein at least one of said microwave transmitter and said microwave receiver is disposed in a guide face of a pneumatic printing stock guide element for guiding the varnished printing stock along a travel path thereof at a substantially constant spacing from said guide face.

14. The dryer-controlling device according to claim 6, wherein said microwave receiver is disposed in a circumferential surface of a rotating printing press cylinder, and said microwave transmitter associated therewith is disposed locally fixed near said circumferential surface of said printing press cylinder.

15. The dryer-controlling device according to claim 6, including a device located downstream from the dryer, as viewed in a travel direction of the printing stock through the printing press, for applying to the dried printing stock an offset spray powder in a quantity variable by said powder-applying device as a function of said status variable.

* * * * *